US005131325A

United States Patent [19]

Blauvelt

[11] Patent Number: 5,131,325

[45] Date of Patent: Jul. 21, 1992

[54] REUSABLE PRINTING SLEEVE

[75] Inventor: Richard M. Blauvelt, Baltimore, Md.

[73] Assignee: Flexographic Technology, Inc., Baltimore, Md.

[21] Appl. No.: 693,534

[22] Filed: Apr. 30, 1991

[51] Int. Cl.[5] ..... B41F 13/10

[52] U.S. Cl. ..... 101/375; 29/127; 138/129; 138/130; 138/150; 138/154

[58] Field of Search ..... 101/375, 376; 156/195; 428/36.91; 29/127; 138/129, 130, 132, 144, 150, 154; 242/118.32

[56] References Cited

U.S. PATENT DOCUMENTS

| | | | |
|---|---|---|---|
| 444,233 | 1/1891 | Denney | 138/150 |
| 477,593 | 6/1892 | Greenfield | 138/150 |
| 2,536,243 | 1/1951 | Walker | 138/73 |
| 3,146,709 | 9/1964 | Bass | 101/375 |
| 3,978,254 | 8/1971 | Hoexter | 428/36 |
| 4,089,265 | 5/1978 | White | 101/375 |
| 4,903,597 | 2/1990 | Hoage et al. | 101/375 |

*Primary Examiner*—Edgar S. Burr
*Assistant Examiner*—Stephen R. Funk
*Attorney, Agent, or Firm*—Charles F. Obrecht, Jr.

[57] ABSTRACT

A reusable printing sleeve for supporting flexible printing plates, the sleeve having a limited circumferential resilience, whereby when subjected to air jets emitted from the apertures in the wall of a printing cylinder, the sleeve is dilated to facilitate the application of the sleeve to the cylinder or its removal therefrom. The sleeve is constituted by four or five interlaminated layers. The innermost one or two layers are comprised of wide strips of plastic film helically wound about a cylindrical shape. The outer three layers of the sleeve are constituted of three interlaminated layers each formed by helically wound of synthetic plastic tape. All three outer layers are wound at helix angles substantially different from the innermost layer or layers. Two of the outermost layers of the sleeve are wound at the same helix angle but are phase displaced relative to each other, whereby the air gap between the convolutions of one layer is bridged by the convolutions of the other, thereby sealing the gap and rendering the sleeve impermeable to air. The remaining layer is wound at an angle opposed to the helix angle of the other two, thereby strengthening and rigidifying the structure of the sleeve.

8 Claims, 3 Drawing Sheets

Figure 2
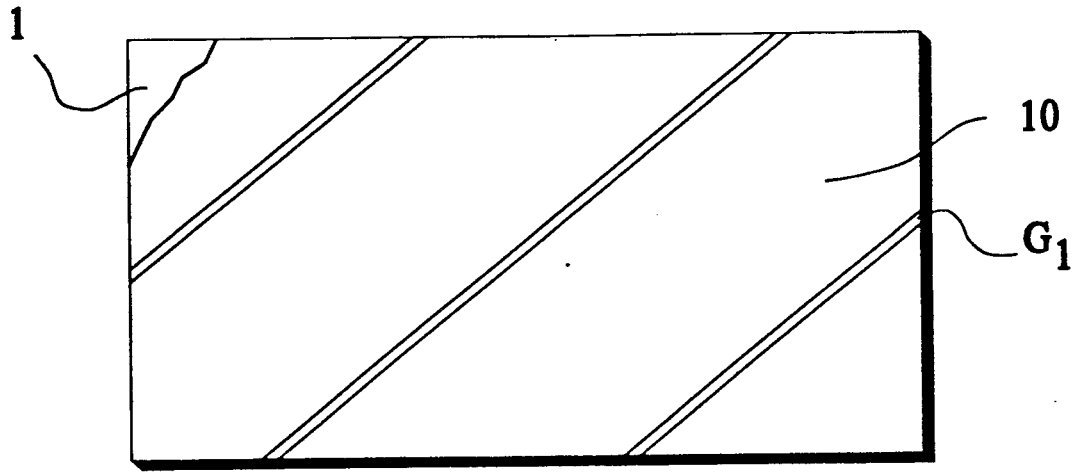
Figure 3
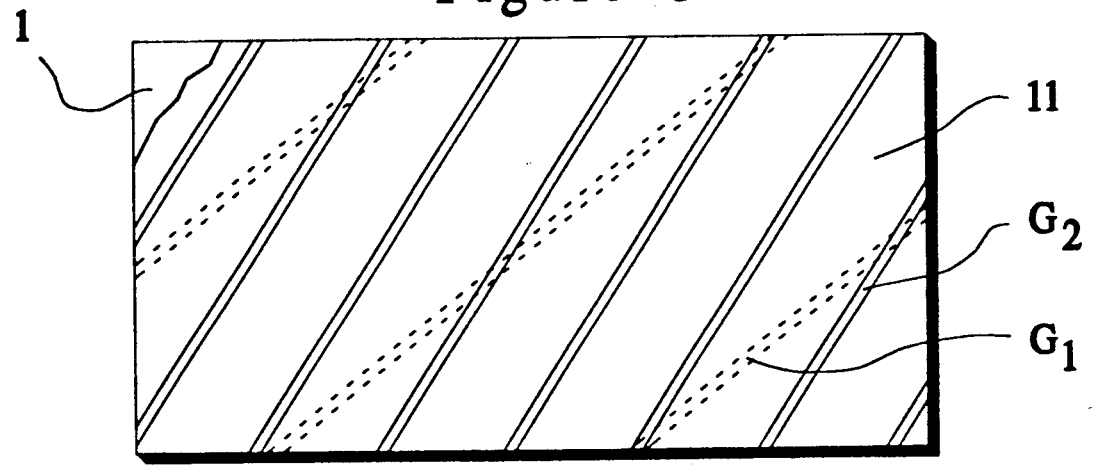
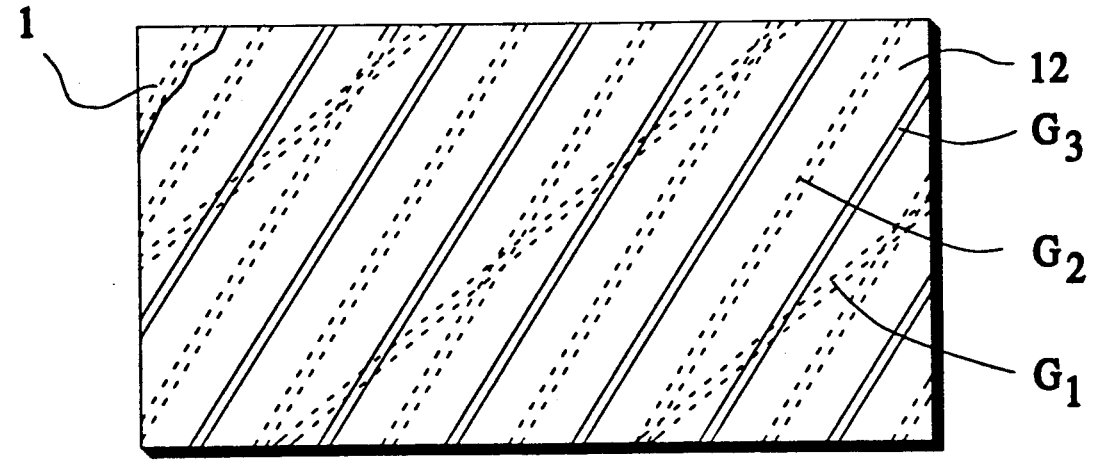
Figure 4

REUSABLE PRINTING SLEEVE

BACKGROUND OF THE INVENTION

1. Field of the Invention

The invention relates to an improved reusable flexographic printing sleeve.

2. Related Art

Printing sleeves are used in the flexographic printing process. In the original process, flexible printing plates were mounted to cylindrical mandrels to support the plates in a printing press. Due to the time consuming and sometimes difficult task of removing the flexible plates from the mandrel to remount new plates for different jobs, a cylindrical flexible base or sleeve was fabricated to slide over the mandrel and the printing plates were attached thereto as disclosed in U.S. Pat. No. 3,146,709 (Sep. 1, 1964) issued to Waldo E. Bass. In this way, sleeves could be removed from the mandrel quickly and a new sleeve with different printing plates could be mounted. Use of the sleeve had two (2) advantages, (1) a series of sleeves could be made ready to mount over a mandrel for quickly setting up successive runs of the press, and (2) the number of expensive mandrels needed to make successive runs was substantially reduced.

One problem with the use of sleeves was the difficulty associated with removal from the mandrel caused by friction between the metal mandrel and the plastic innermost layer of the sleeve. Bass (U.S. Pat. No. 3,146,709) disclosed a method of providing quick and easy removal of a sleeve from a mandrel with the use of a hollow mandrel having a pattern of apertures formed therein, through which air under pressure was passed to impinge upon the sleeve. The air pressure created a thin cushion of lubricating air between the mandrel and the sleeve allowing the sleeve to slide easily on and off of the mandrel. When the air pressure was reduced to ambient, the sleeve would frictionally bind itself securely around the mandrel.

Bass disclosed a sleeve made from a sheet of polyester plastic material having its edges on a bias and in abutting relation to each other. The cylindrical shape was disclosed as being maintained by helically winding a tape or strip of material with pressure sensitive adhesive, around the outside of the cylindrical body. A second layer, made of tape, was disclosed as helically wound about the first layer. The flexible printing plates with "sticky back" could then be mounted on the sleeve.

One problem with this type of sleeve was its propensity to allow air to pass through the sleeve by way of air gaps formed at the junction of the biased edges of the polyester plastic inner layer, which are not fully sealed by the helically wound paper strips and tape. Air leakage reduces the beneficial effect of the cushion of air on the one hand, and can adversly impinge upon and affect the mounted printing plates on the other. Another problem with the Bass sleeve is the "tear drop" shape it assumes when not in use.

As discussed in U.S. Pat. No. 3,978,254 issued Aug. 31, 1976 to Hoexter, and assigned to Mosstype Corporation (Mosstype), sleeves used at the time of the Bass disclosure were formed by joining the abutting ends of a rectangular sheet of film material over which plastic tape was helically wound. A second layer of plastic tape was then helically wound in the opposite direction over the first. Air gaps, though reduced in size, still existed with this type of sleeve. The "tear drop" shape remained a problem when the sleeve was not in use on a mandrel.

A further limitation upon the use of inner layers formed by one sheet rectangles or parallelograms, was that any length or diameter tube could not be readily manufactured without cutting the sleeve material to a specific size.

The Mosstype patent disclosed a sleeve formed by three (3) interlaiminated layers, each consisting of helically wound plastic tape. Two (2) of the helices are shown as wound in the same direction but offset axially relative to each other, i.e. "phased displaced", so that the air gap of the first layer is covered by the second layer. The third helix was shown as formed by winding the tape in the opposite direction of the first two layers. While this sleeve has the advantage of preventing air seepage therethrough, the gaps inherent in the winding of numerous revolutions of tape is apparent, and while the second two layers prevent air from impinging directly upon the printing plates, air forced into the gaps of the first and second layers can impinge directly upon the third layer and indirectly upon the attached printing plates. Another disadvantage of sleeves made by this method is their tendency to twist along the helix angle during a run of the press. Even a slight twisting action can cause the resulting print to be unacceptably distorted.

SUMMARY AND OBJECTS OF THE INVENTION

In view of the foregoing discussion, it is an object of this invention to provide a flexible printing sleeve comprising a first layer formed from a wide strip of high strength, chemically inert polyester or other plastic material helically wound, with abutting edges, around a cylinder or forming mandrel. The helical angle generally approximates 45 degrees but will vary in relation to the diameter of the sleeve. The polyester is then covered with three layers of high strength, chemically inert tape. The first layer of tape is helically wound at an angle substantially greater than the helical angle of the wide strips of polyester. The second layer of tape is helically wound about the first layer at the same helical angle as the first layer, but the center line of the tape of the second layer is applied over the seams formed by the edges of the tape of the first layer, thus substantially sealing the air gaps between the abutting edges of the wide strip, and the first layer of tape. The third layer of tape is helically wound at the same but opposite angle of the second layer.

The sleeve of the present invention so formed; is readily adaptable for use with the air pressure mechanism for installation onto and removal from a mandrel; holds its circular shape when removed from the mandrel; is impermeable to air; can be manufactured in any length and diameter; will not twist while in use on a printing run; and can be made thicker for use on various jobs with the same mandrel.

BRIEF DESCRIPTION OF THE FIGURES

FIG. 2 is a side view illustrating the first step in forming the sleeve.

FIG. 3 is a side view illustrating the second step in forming the sleeve.

FIG. 4 is a side view illustrating the third step in forming the sleeve.

DETAILED DESCRIPTION OF THE PREFERRED EMBODIMENT

Since the use of flexible printing sleeves has come into use in conjunction with the pressurized mandrel disclosed by Bass, sleeves have been manufactured with the use of layers of tape over a first or inner layer formed by a rectangular piece of plastic, and covered with paper or plastic tape. Other materials such as fiberglass and even metal and use of tape only, have also been used. Rubber printing plates are adhesively fastened directly onto the sleeves by means of plastic tape with adhesive on both sides to engage the sleeve and the rubber printing plates.

The sleeves must be of a thickness which will provide the required rigidity against twisting while in use on the mandrel, and to hold its cylindrical shape when not in use. At the same time, the sleeve must be thin enough to maintain the required overall diameter of the mandrel assembly used in printing.

The standard diametric distance between the mandrel surface and the top of the printing plate is 0.125 to 0.1275 inches. The thickness of the rubber printing plates is 0.105 to 0.107 inches. Thus, in order to use existing mandrels, sleeves are constructed to be approximately 0.015 inches thick. The required thickness has been accomplished in various ways with materials whose thickness in combination, yields the desired dimension.

Figure 1:
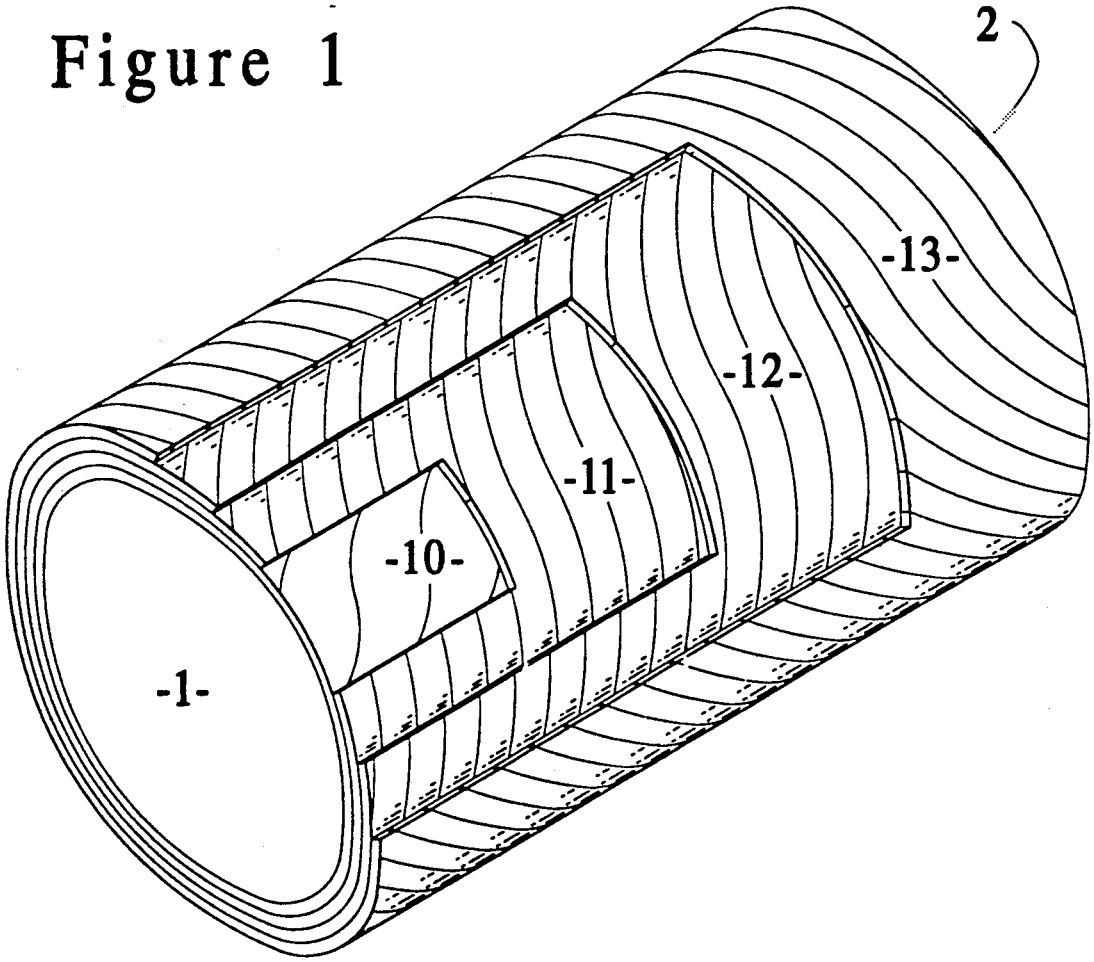
FIG. 1 is a perspective view of the preferred embodiment of the printing sleeve of the present invention.

FIG. 1 shows the improved sleeve (2) of the preferred embodiment of the present invention. It is constructed of four layers. The innermost layer (10) is made from a wide strip of polyester or other suitable material approximately 0.004 to 0.006 inches thick and 4 to 10 inches wide. The wide strip, as shown in FIG. 2, is helically wound around a forming cylinder of the same diameter as the desired diameter mandrel (1) and the ends are taped down to hold the polyester to the forming cylinder until fixed by the other layers of tape. The helical angle formed by the abutting edges of the wide strip (10) yields an angle from the horizontal of about 45 degrees. Care must be taken to close the gap (G1) between the edges of the strip as far as possible. It is the use of the wide strip of polyester as the first or innermost layer which comprises the improvement of the sleeve of the present invention.

Figure 5:
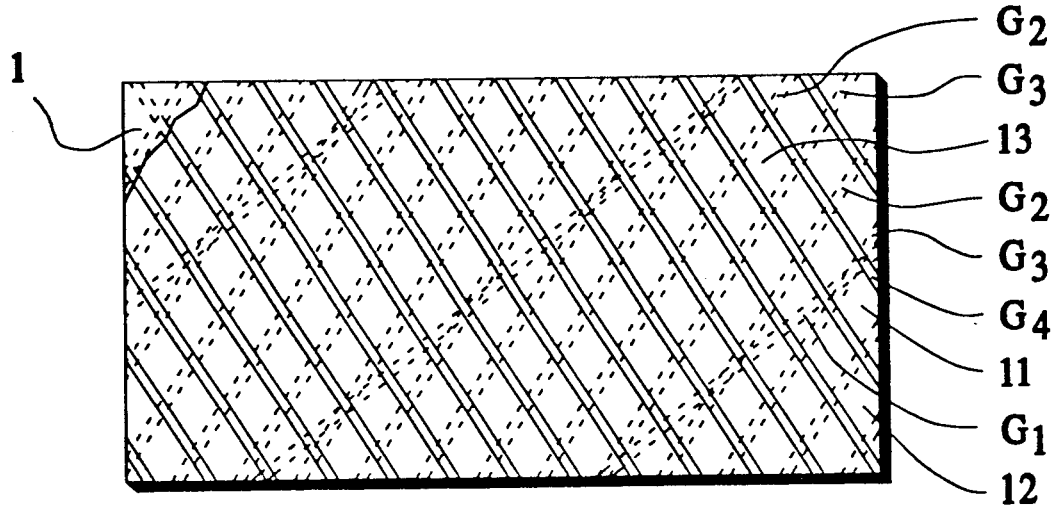
FIG. 5 is a side view of the fourth and final step in forming the sleeve.

The next three layers (11, 12, 13) as shown in FIG. 5, consist essentially of helically wound tape made of plastic or other like material with adhesive on one side and having a thickness of about 0.0035 inches each. The angle of the abutting edges of the tape of the first layer as shown in FIG. 3 is about 80 degrees from the horizontal (which angle will vary with sleeve diameter), thus contributing to the overall structural rigidity of the sleeve (2). Again, care must be taken to cause the edges of the tape to abut as closely as possible to reduce the air gap therebetween as shown as G2 on FIG. 3.

FIG. 4 shows that the second layer of tape (12) is, like the first layer of tape (11) helically wound around the forming mandrel (10) and adhesively attached to the first layer of tape (11). The second layer (12) is wound to the same helical angle as the first but is shifted such that the center of the tape covers the joints formed by the first layer, thus closing air gaps G1 and G2 as shown in FIG. 4. The tape winding is usually accomplished with the use of a forming mandrel and a tape dispensing mechanism which advances along the axis of the forming mandrel a distance equal to the tape lead for each revolution.

The third layer of tape (13) as shown on FIG. 5, is made from the same material as the first and second layers. The third layer (13) is helically wound in the opposite direction to criss-cross the first two layers of tape so as to further seal the sleeve from the passage of air therethrough, and to further strengthen the sleeve. The helical angle formed by the abutting edges of the third layer of tape is equal to but opposite from the horizontal angle formed by the edges of the first two layers of tape.

The ends of the four layered sleeve are then trimmed and covered with the glasscloth tape to rigidify and strengthen the end edges. Air pressure is then applied and the sleeve is thus easily removed from the forming mandrel.

Figure 6:
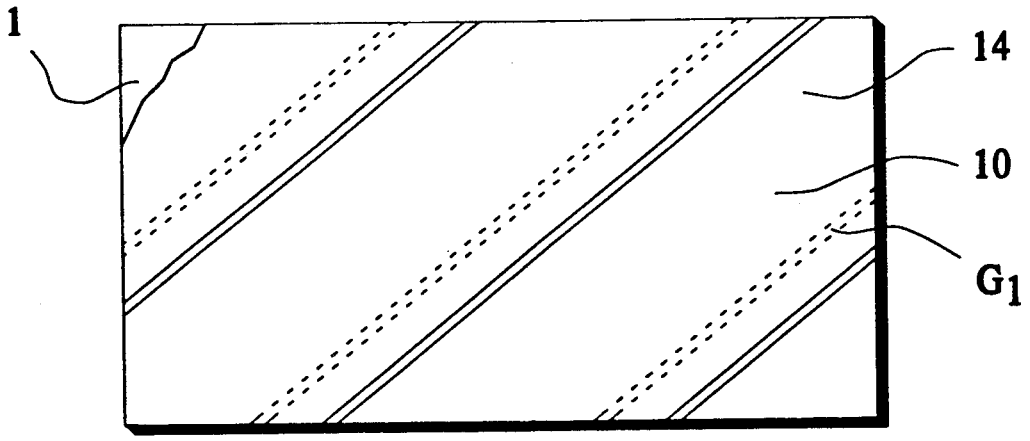
FIG. 6 is a side view of the second embodiment of the invention showing the use of two layers of the wide strips.

It will be appreciated that the direction of the windings of the polyester first layer, and the three tape layers may vary in direction, from left to right or right to left, provided that impermeability to air and the rigidity of the sleeve are maintained. It will also be appreciated that thicker tape or film layers having adhesive on one side or both sides can be used to increase the printing diameter of the sleeve such that one size mandrel can be "built up" with a thicker sleeve to be used instead a larger mandrel. As shown in FIG. 6, one or two layers of sticky-back flexible plastic material (14) approximately 0.025 inches thick each can be helically wound to form the innermost layer in combination with the three single sided tape layers to form a sleeve having an overall thickness, of as much as 0.0605 inches without adversely affecting the printing.

Intermediate thickness can also result from the use of an inner layer 0.004 to 0.006 inches thick with a second layer 0.025 inches thick. The same mandrel used for the approximately 0.015 inch thick sleeve can thus accommodate sleeve thicknesses up to 0.0605 inches without having to use the larger diameter mandrels.

While two embodiments of the present invention have been described, it will be understood that it is capable of further modification, and this application is intended to offer any variation, uses, or adaptions of the invention, following in general, the principles of the invention and including such departures from the present disclosures as to come within the knowledge or customary practice in the art to which this invention pertains, and as may be applied to the essential features hereinbefore set forth and falling within the scope of the invention or the limit of the appended claims.

I claim:

1. An improved reusable printing sleeve having a circular form for supporting flexible printing plates, said sleeve having a predetermined length and having limited circumferential resilience whereby the sleeve is slidable over and removable from an apertured printing cylinder adapted to emit air jets serving to dilate the sleeve, said sleeve comprising four interlaminated layers, three of which are each formed by a helix of flexible tape whose convolutions are separated by an air gap, said tapes being formed of thin synthetic plastic film material which is of high strength and is chemically inert, two of said helices being wound at the same angle and being displaced in phase relative to each other, whereby the gap in one helix is bridged by the convolutions of the other helix to render the sleeve impermeable to air, the remaining helix being wound at a different angle which is equal and opposite to the angle of the two helices, whereby the convolutions thereof intersect the convolutions of the underlying helix to strengthen and rigidify the sleeve, said plastic film tapes having gauges producing an overall tape thickness of about 0.0105 inches, said interlamination of said tapes being effected by an adhesive coating on the inner face of the outermost layer of tape whereby the outermost layer of tape is bonded to the intermediate layer which is bonded to the innermost layer of tape wherein the improvement comprises:

a first layer comprising a helix of flexible material about 4 inches to 10 inches wide which is removably wound into a cylindrical form about the exterior of a cylindrical body and rigidified by the innermost layer of tape adhesively bonded thereto and the intermediate layer of tape adhesively bonded to the said innermost layer of tape, and the outermost layer of tape adhesively bonded to the said intermediate layer of tape.

2. The improved reusable printing sleeve as in claim 1 wherein the said first layer is helically wound at an angle substantially different from the angles of the three helices of the three layers of tape.

3. An improved reusable printing sleeve having a circular form for supporting flexible printing plates, said sleeve having a predetermined length and having limited circumferential resilience whereby the sleeve is slidable over and removable from an apertured printing cylinder adapted to emit air jets serving to dilate the sleeve, said sleeve comprising five interlaminated layers, three of which are each formed by a helix of flexible tape whose convolutions are separated by an air gap, said tapes being formed of thin synthetic plastic film material which is of high strength and is chemically inert, said material having sufficient stretchability to permit limited circumferential dilation of the sleeve under air pressure, two of said helices being wound at the same angle and being displaced in phase relative to each other, whereby the gap in one helix is bridged by the convolutions of the other helix to render the sleeve impermeable to air, the remaining helix being wound at a different angle which is equal and opposite to the angle of the two helices, whereby the convolutions thereof intersect the convolutions of the underlying helix to strengthen and rigidify the sleeve, said plastic film tapes having gauges producing an overall tape thickness of about 0.0105 inches, said interlamination of said tapes being effected by an adhesive coating on the inner face of the outermost layer of tape whereby the outermost layer of tape is bonded to the intermediate layer which is bonded to the innermost layer of tape wherein the improvement comprises:

(a) a first layer comprising a helix of flexible material about 4 inches to 10 inches wide which is removably wound into a cylindrical form about the exterior of a cylindrical body and rigidified by the innermost layer of tape adhesively bonded thereto and the intermediate layer of tape adhesively bonded to the said innermost layer of tape, and the outermost layer of tape adhesively bonded to the said intermediate layer of tape, and (b) a second layer comprising a helix of flexible material about 4 inches to 10 inches wide is helically wound about and adhesively bound to the first layer and being displaced in phase relative to said first layer.

4. The improved reusable printing sleeve as in claim 3 wherein the said first and second layers are helically wound at an angle substantially different from the angles of the three helices of the three layers of tape.

5. The improved reusable printing sleeve as in claim 4 wherein the said first layer has a thickness of about 0.004 inches to 0.006 inches and the said second layer has a thickness of about 0.025 inches.

6. The improved reusable printing sleeve as in claim 4 wherein the said first and second layers each have a thickness of about 0.025 inches.

7. The improved reusable printing sleeve as in claim 3 wherein the said first layer has a thickness of about 0.004 inches to 0.006 inches and the said second layer has a thickness of about 0.0025 inches.

8. The improved reusable printing sleeve as in claim 3 wherein the said first and second layers each have a thickness of about 0.025 inches.

* * * * *